US007267712B2

(12) United States Patent
Chang et al.

(10) Patent No.: US 7,267,712 B2
(45) Date of Patent: Sep. 11, 2007

(54) PLANAR ELECTRIC PRECIPITATOR

(75) Inventors: Kai-Cheng Chang, Taipei (TW); Chia-Yuan Chang, Hsinchu (TW)

(73) Assignee: Industrial Technology Research Institute

( * ) Notice: Subject to any disclaimer, the term of this patent is extended or adjusted under 35 U.S.C. 154(b) by 331 days.

(21) Appl. No.: 11/043,007

(22) Filed: Jan. 24, 2005

(65) Prior Publication Data

US 2006/0130658 A1 Jun. 22, 2006

(51) Int. Cl.
*B03C 3/12* (2006.01)
*B03C 3/40* (2006.01)

(52) U.S. Cl. ..... 96/77; 96/95; 96/97; 96/98

(58) Field of Classification Search ..... 96/77, 96/95, 97, 98, 79, 86, 84, 87
See application file for complete search history.

(56) References Cited

U.S. PATENT DOCUMENTS 4,734,105 A * 3/1988 Eliasson et al. ..... 95/62
5,009,683 A * 4/1991 Sun ..... 96/66
5,322,550 A * 6/1994 Park ..... 96/66
5,492,557 A * 2/1996 Vanella ..... 96/16
5,695,549 A * 12/1997 Feldman et al. ..... 96/55
5,733,360 A * 3/1998 Feldman et al. ..... 95/78
5,820,660 A * 10/1998 Ko ..... 96/30
5,925,170 A * 7/1999 Nojima ..... 96/71
6,126,727 A * 10/2000 Lo ..... 96/39
6,183,200 B1 * 2/2001 Chang ..... 416/146 R
6,375,714 B1 * 4/2002 Rump et al. ..... 95/3
6,524,369 B1 * 2/2003 Krigmont ..... 95/78

* cited by examiner

*Primary Examiner*—Richard L. Chiesa

(57) ABSTRACT

A plane type electric precipitator includes an electrode plate of plane shape, made of electricity-conducting material; a collecting plate, parallel to the electrode plate and made of electricity-conducting material; a plurality of electrode units, placed on the electrode plate and having tips; wherein direct electric voltage is applied between the electrode plate and the collecting plate, so that air passing through is exposed to high electric fields close to the tips of the electrode units, ionizing suspended particles and trapping ionized particles at the collecting plate, so that an air-cleaning effect results.

20 Claims, 10 Drawing Sheets

PLANAR ELECTRIC PRECIPITATOR

BACKGROUND OF THE INVENTION

1. Field of the Invention

The present invention relates to a planar electric precipitator, particularly to a planar electric precipitator which is easy to manufacture and of flat shape to be suitable for industrial and home use.

2. Description of Related Art

In conventional art, particles suspended in the air are removed by letting an air flow pass through a channel in which a pointed electrode is placed. Direct voltage between the electrode and a collecting plate causes the particles contained in the air flow to be ionized and drawn towards the collecting plate and thus to be removed from the air.

Electrostatic air cleaning apparatuses as just described work effectively and therefore are widely used to clean air in closed rooms. However, conventional electrostatic air cleaning apparatuses generally have large volumes and need to be placed on floors, which consumes valuable space and is inconvenient.

The main reason for a large volume of a conventional electrostatic air cleaning apparatus lies in a large thickness due to required distances between electrodes and collecting plates and the need to install several layers of electrodes and collecting plates for better effectivity.

Another shortcoming of conventional electrostatic air cleaning apparatuses is the difficulty during manufacture of precisely controlling distances and mutual orientations between electrodes and collecting plates, so as to prevent smoke from entering air channels and preserving ionizing capability.

The present inventor has been aware that conventional art does not solve the problems of large volume, difficulty of manufacturing and cost reduction. U.S. patent publication no. US005925170A "Electric dust-collection unit and air-cleaning apparatus" discloses an electrostatic air cleaning apparatus having a plurality of electrodes, each made of a wire with a needle tip, oriented parallel to each other, which results in a large thickness and hence a large volume of the apparatus. Furthermore, the electrodes, being separable from a base, during manufacture need to be placed precisely one by one, which is difficult and expensive.

U.S. patent publication no. US006524369B1 "Multi-stage particular matter collector" discloses an electrostatic air cleaning apparatus having a plurality of electrodes, each being a metal plate with sharp edges, vertically placed on a horizontal collector plate. Therefore, the apparatus has a height that is hard to reduce, resulting in a large volume.

U.S. patent publication No. US005322550A "Electrical dust collector" discloses an electrostatic air cleaning apparatus having a plurality of electrodes which are made by punching and bending a metal plate and a plurality of collecting plates made by punching and bending a metal plate, too, and interleaving with the plurality of electrodes. This apparatus has a somewhat reduced thickness, but a satisfactorily small volume is not achieved. Furthermore, manufacturing by punching and bending into precise angles is difficult due to the elasticity of metal plates, so that precision and hence effectivity of the apparatus are not sufficiently high.

U.S. patent publication No. US005492557A "Filter device for air purification" discloses an electrostatic air cleaning apparatus having a plurality of electrodes which are made from a metal plate by punching a plurality of holes with pointed flaps reaching inside and being bent away at predetermined angles to form electrodes. Thereby the apparatus is almost flat, but a minimum thickness is still required by orienting a collecting plate perpendicular to the electrodes.

SUMMARY OF THE INVENTION

It is an object of the present invention to provide a plane type electric precipitator having a flat shape.

Another object of the present invention is to provide a plane type electric precipitator which is easy to manufacture and maintains precision.

The present invention mainly comprises a discharging plate, a collecting plate, oriented parallel thereto, a plurality of electrode units, placed on the electrode plate at equal mutual distances and made by punching or laser cutting. Each discharging unit has an electrode opening and at least two electrode tips, placed therein at rotationally symmetric positions. The collecting plate has a plurality of collectors at positions that correspond to positions of the electrode units on the electrode plate. Each collecting unit has a collector surface, shaped like a depression and surrounded by several air-holes. Direct electric voltage is applied between the electrode plate and the collecting plate, so that air passing through is exposed to high electric fields close to the tips of the discharging units, ionizing suspended particles and trapping ionized particles at the collecting plate, so that an air-cleaning effect results. A cover plate covers the electrode plate, preventing accidental touching thereof and providing a decorative look.

Due to a flat shape, the present invention is placeable on walls ceilings or floors, without consuming valuable space. Producing the electrode plate and the collecting plate by punching or laser cutting allows for easy manufacturing and precise controlling of dimensions and positions of the electrode units and collecting units, optimizing air-cleaning effectivity of the present invention.

The present invention can be more fully understood by reference to the following description and accompanying drawings.

DETAILED DESCRIPTION OF THE PREFERRED EMBODIMENTS

Figure 1:
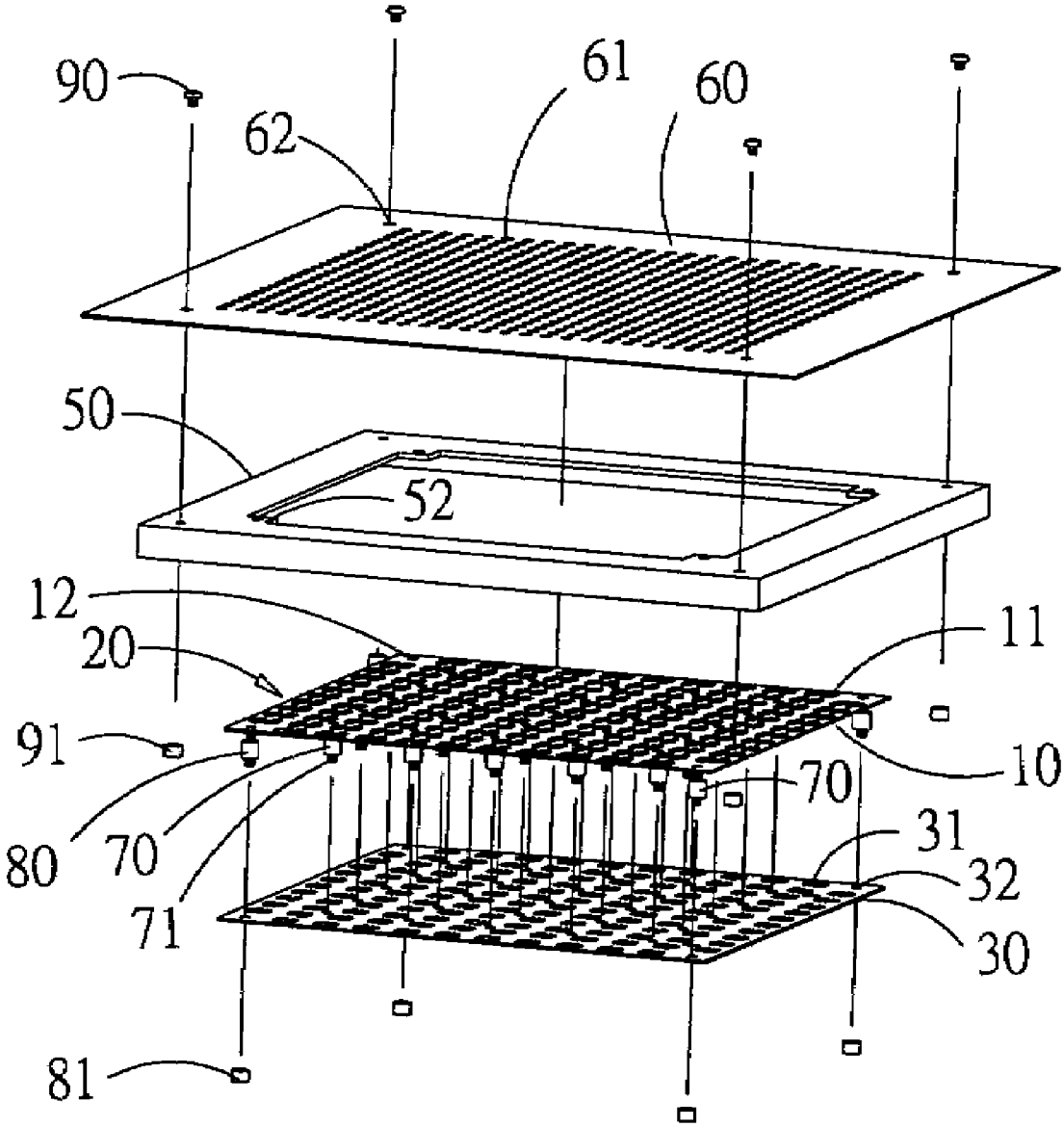
FIG. 1 is an exploded perspective view of the plane type electric precipitator of the present invention in the first embodiment.

As shown in FIG. 1, the plane type electric precipitator of the present invention comprises: a electrode plate 10; a plurality of electrode units 20; a collecting plate 30; a plurality of collecting units 40; a frame 50; a cover plate 60; and a plurality of fixing elements 70. The electrode plate 10 is made of electricity-conducting metal and carries the electrode units 20. The electrode units 20 serve to ionize particles suspended in air. The collecting plate 30 is oriented parallel to the electrode plate 10. Direct voltage is applied between the electrode plate 10 and the collecting plate 30, so that particles flowing by in between are ionized. The-collecting units 40 are mounted on the collecting plate 30 in positions corresponding to the electrode units 20 to increase effectiveness. The frame 50 carries both the electrode plate 10 and the collecting plate 30. The cover plate 60 is mounted on the frame 50, covering the electrode plate 10, protecting against accidental touching thereof, and is preferably made as a decorative object. The fixing elements 70 fix a relative position of the electrode plate 10 against the collecting plate 30.

Figure 4:
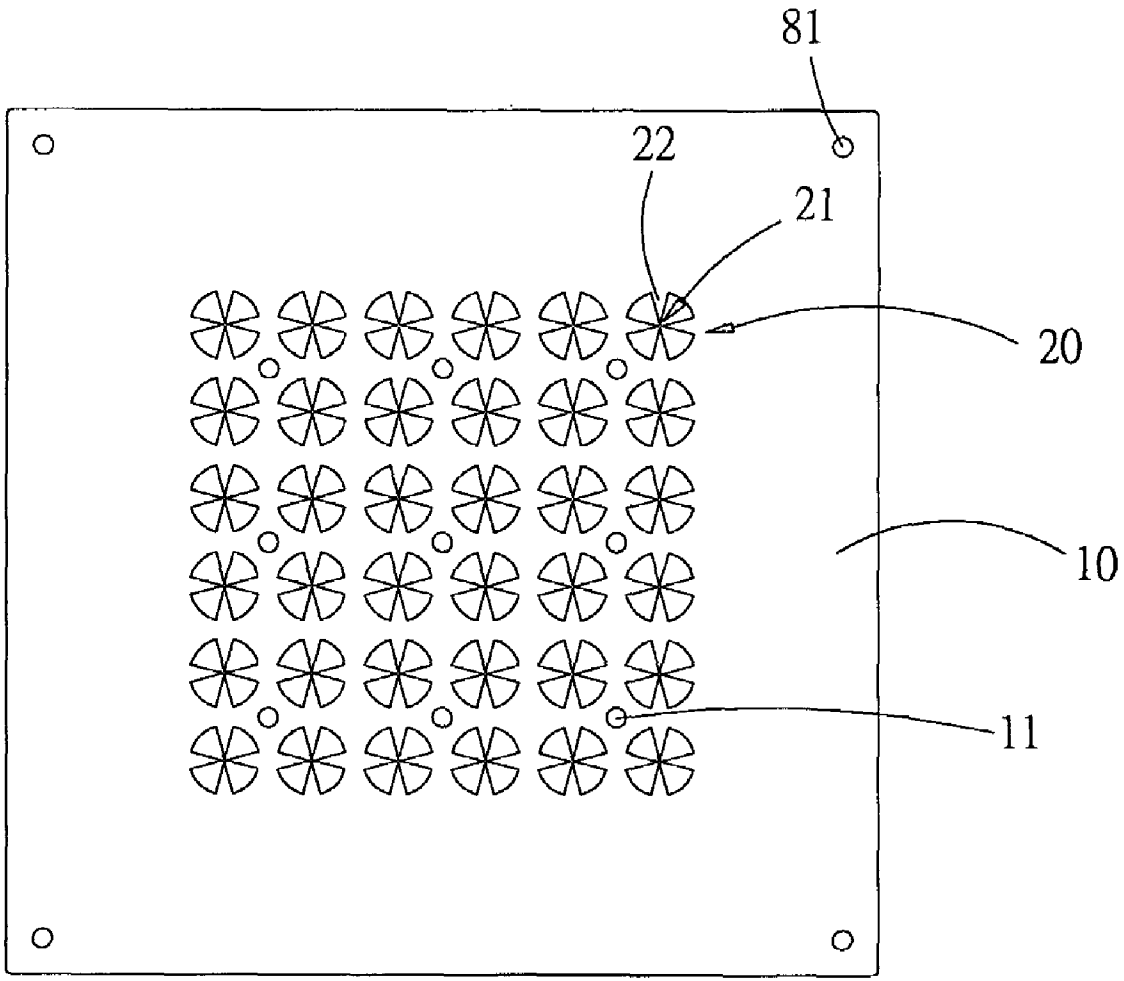
FIG. 4 is a top view of the electrode plate of the present invention in the first embodiment.

Referring to FIGS. 1 and 4, the electrode plate 10 is made of electricity-conducting metal and carries the electrode units 20. As shown in FIG. 4, each of the electrode units 20 has an electrode opening 21. Each electrode opening 21 has an inner periphery in which a plurality of electrodes 22 are placed in rotationally symmetric positions. Neighboring electrode units 20 have equal distances and are equally oriented.

In a first embodiment of the present invention, the electrodes 22 are oriented parallel to the electrode plate 10 and are made by punching or laser cutting, delineating circumferences of the electrode openings 21 and the electrodes 22, so that manufacturing is simple and precision is easily controlled. For the electrode units 20 and the electrode plate 10, readily available parts are used, so that no complicated assembly process is required and cost is reduced.

Figure 2:
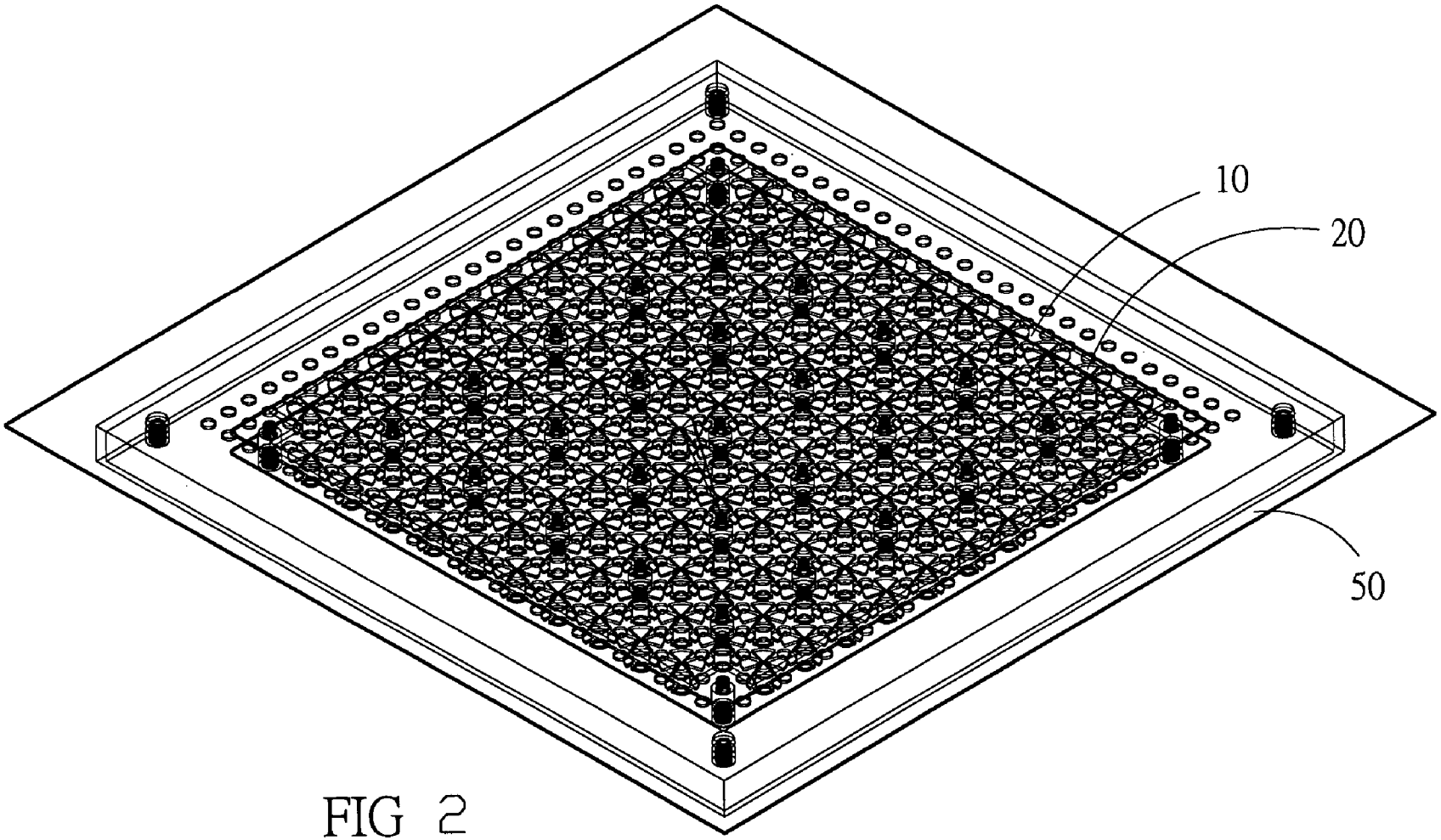
FIG. 2 is a perspective view of the plane type electric precipitator of the present invention in the first embodiment.
Figure 5:
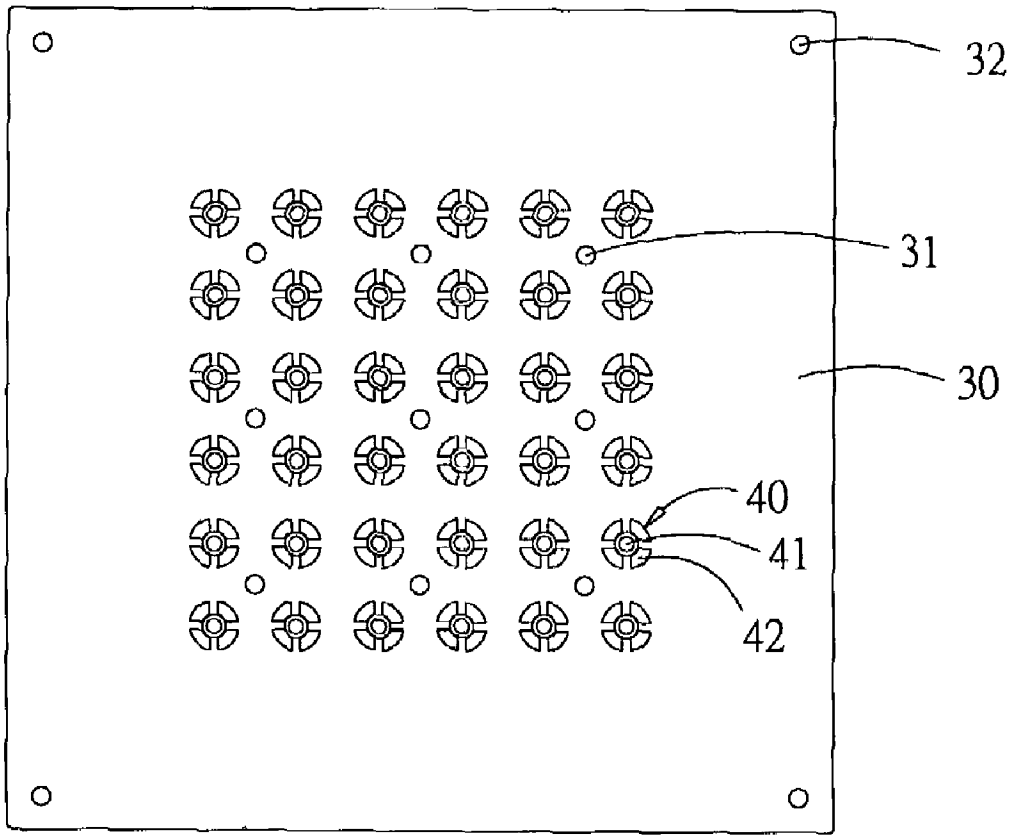
FIG. 5 is a top view of the collecting plate of the present invention in the first embodiment.
Figure 6:
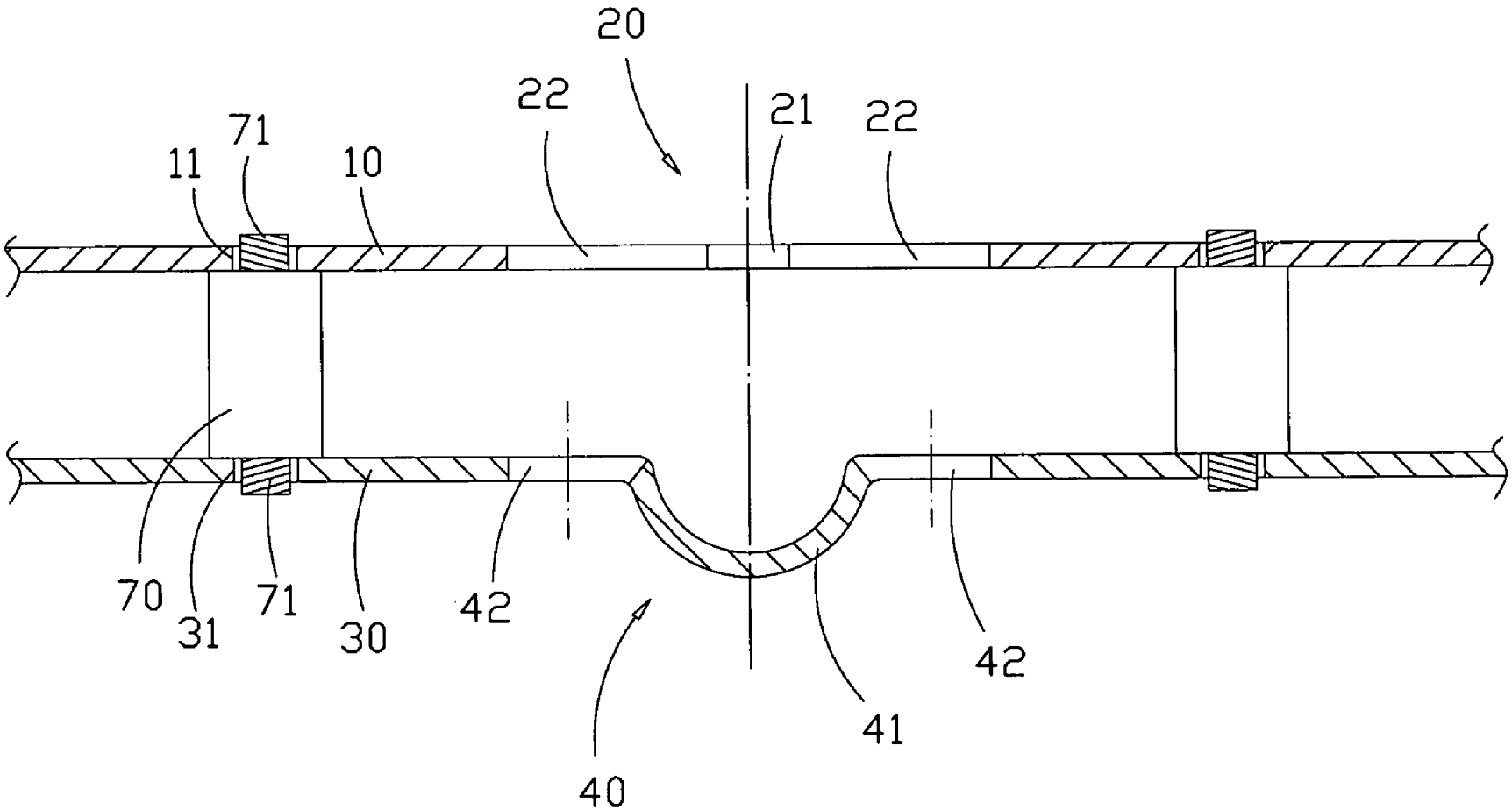
FIG. 6 is an enlarged cross-sectional view of the electrode plate and the collecting plate of the present invention in the first embodiment.

Referring to FIGS. 1, 2 and 6, the collecting plate 30 is mounted below the electrode plate 10., with the collecting units 40 and the electrode units 20 facing each other. As shown in FIGS. 5 and 6, each of the collecting units 40 has a collector surface 41, which is formed as a round depression surrounded by several air holes 42. The collectors surfaces 41 are made by punching, and the air holes 42 are made by punching or laser cutting, resulting in a simple manufacturing process.

Referring again to FIG. 6, the electrode units 20 on the electrode plate 10 and the collecting units 40 on the collector plate 30 are placed at positions corresponding to each other. The electrode openings 21 of the electrode units 20 allow air to pass through. Furthermore, since the holes 21 and the collectors surfaces 41 are aligned to each other, air that has passed through one of the electrode openings 21 is directed towards one of the collectors surfaces 41 at a corresponding position. Air hits the collectors surfaces 41, which are formed like circular depressions, before escaping through the respective surrounding air holes 42. Therefore, the collector surfaces 41 cause stagnation flow downstream of said electrode openings 21 and air stays close to the collector plate 30 for an extended period, enhancing the effectiveness of particle collection. Furthermore, due to the shape of the collectors surfaces 41 large quantities of particles are readily collected therein.

Direct voltage is applied between the electrode plate 10 and the collector plate 30, so that particles in the air close to tips of the electrodes tips 22 are exposed to a high electric field and ionized. Ionized particles are, due to the electric field between the electrode plate 10 and the collector plate 30, drawn towards the collecting plate 30 and trapped there.

For fixing the relative position of the electrode plate 10 against the collecting plate 30 and simplifying assembly, the plurality of fixing elements 70 pass through both the electrode plate 10 and the collecting plate 30. As shown in FIGS. 1 and 6, each of the fixing elements 70 is shaped like a cylinder with a middle section of a relatively large diameter and two opposite end sections 71 of relatively small diameters. The end sections fit tightly into fixing holes 11 on the electrode plate 10 and fixing holes 31 on the collecting plate 30. The fixing holes 11 and the fixing holes 31 are aligned to each other and allow to place the electrode plate 10 and the collecting plate 30 precisely above each other. Furthermore, since the middle sections of the fixing elements 70 have equal lengths, the electrode plate 10 and the collecting plate 30 are kept parallel.

Thereby, the electrodes tips 22 of the electrode units 20 and the collectors surfaces 41 of the collecting units 40 point precisely towards each other and have equal distances, so that ionization as well as air flow work effectively.

Aligning of the electrode units 20 and the collecting units 40 is attainable by various means, which in the scope of the present invention are not restricted to the embodiment described here.

Figure 3:
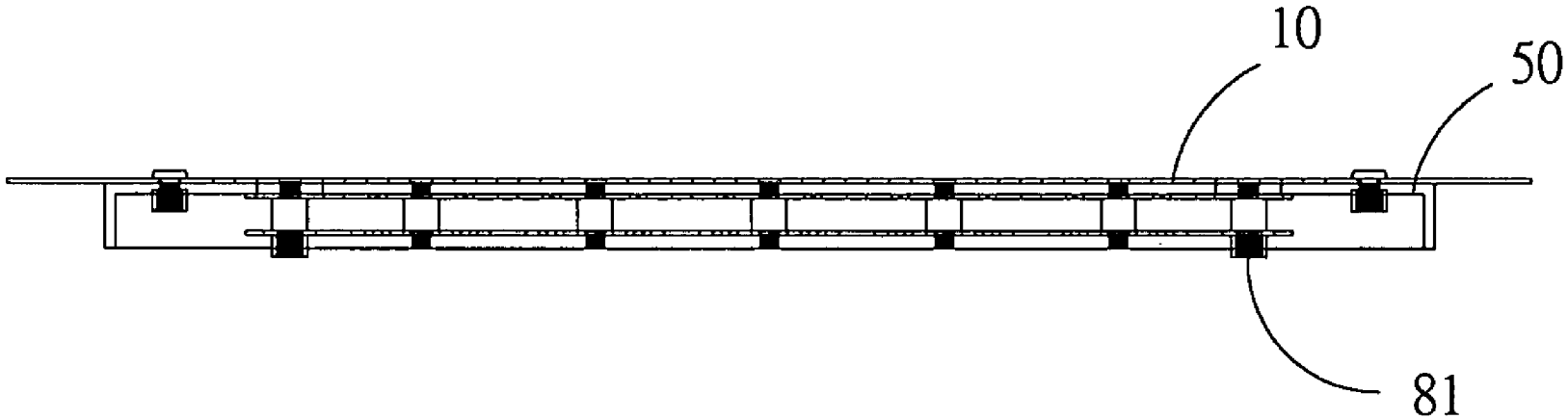
FIG. 3 is a side view of the plane type electric precipitator of the present invention in the first embodiment.

Referring to FIGS. 1-3, the electrode plate 10 and the collecting plate 30 are mounted on the frame 50 using at least four bolts 80 and nuts 81 at four corners thereof. The frame 50 has a central opening 51 with four corners which is slightly smaller than the electrode plate 10 and the collecting plate 30, allowing air to pass through. Threaded holes at the four corners of the central opening 51 accommodate the bolts 80, allowing to fasten the electrode plate 10 and the collecting plate 30 on the frame 50. The frame 50, besides supporting the electrode plate 10 and the collecting plate 30, serves to accommodate electronic and controlling components.

As further shown in FIGS. 1-3, the cover plate 60 covers the central opening 51 of the frame 50 on an outer side thereof. The cover plate 60 has ventilation openings 61 and four threaded holes 62 at four corners, allowing to fasten the cover plate 60 on the frame 50 using screws 90 and nuts 91.

The cover plate 60 serves to prevent accidental contact of a user or of objects with the electrode plate 10. Furthermore, the cover plate 60 is preferably provided with a decorative design for good looks.

In the embodiment described here, the electrode plate 10, the collecting plate 30, the frame 50 and the cover plate 60 all have rectangular shapes. Other suitable geometric shapes, like square, circular or triangular shapes are possible within the scope of the present invention. Preferably, the ventilation openings 61, the electrode unit 20 on the electrode plate 10 and the collecting unit 40 on the collecting plate 30 have equal distances to ensure a uniform air flow for every place of installation of the present invention.

A main characteristic of the present invention lies in the flat shape of the electrode plate 10 and the nearly flat shape of the collecting plate 30, from which the collectors surfaces 41 protrude by small distances only. Thus the electrode plate 10 and the collecting plate 30 combined have only a small thickness, allowing to place the electric precipitator of the present invention at a wall, on a ceiling or on a floor or as an integral part of an air ventilation system, so that no valuable space is wasted.

If hung on a wall, with the cover plate 60 carrying a suitable design, the electric precipitator of the present invention resembles a picture. Suitable designs for placing the present invention at a ceiling or a floor, resembling ceiling elements or wooden floor plates, are also possible.

As compared to conventional art, a further advantage of the present invention lies in easy manufacturing of the electrode plate 10 and the collecting plate 30 by punching or laser cutting, allowing to work the electrode units 20 and the collecting units 40 in a simple and precise way with well-defined dimensions and shapes. Aligning the electrode units 20 and the collecting units 40 by the fixing elements 70 is easy and quickly performed, reducing manufacturing cost.

Figure 7:
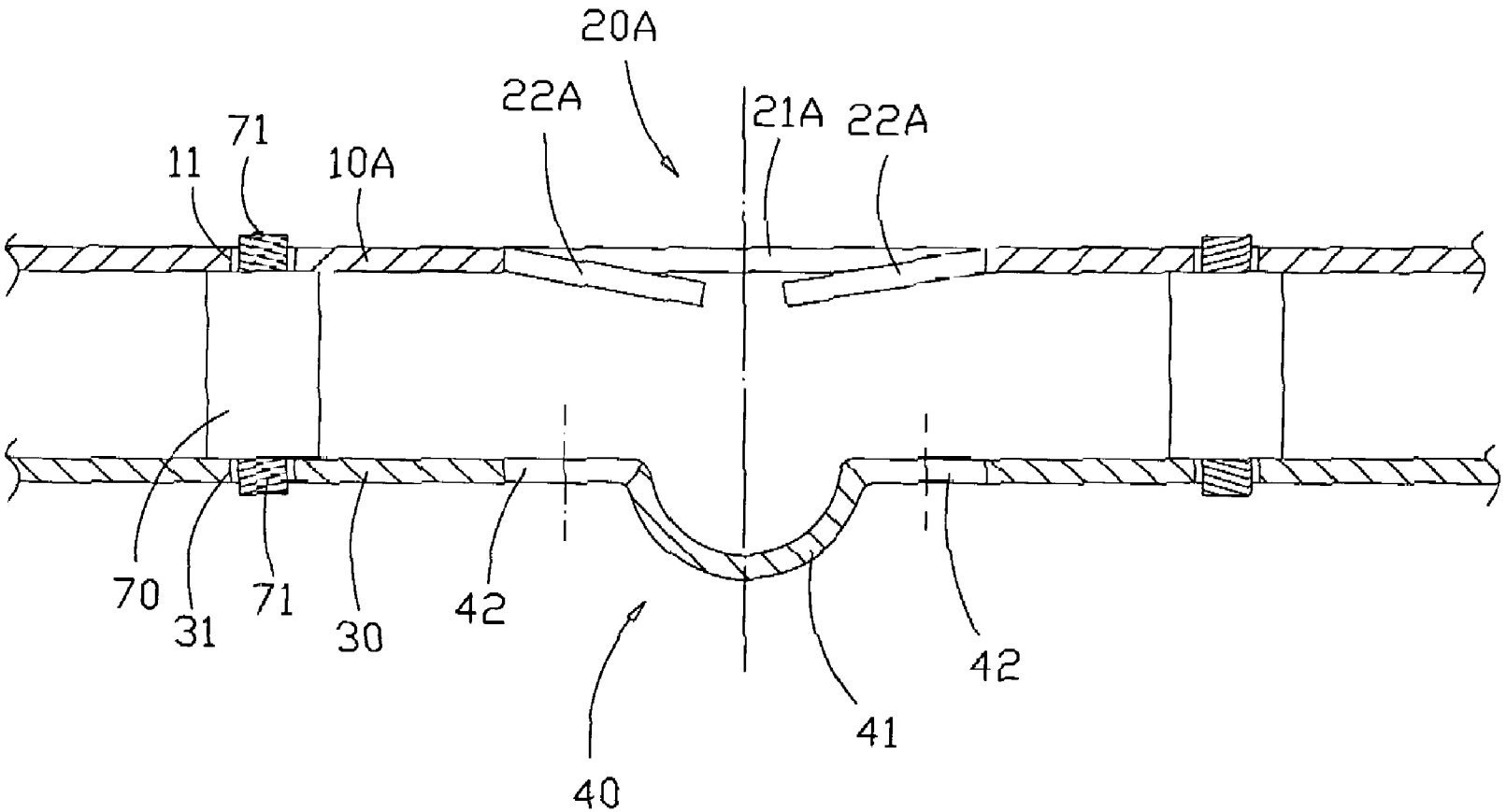
FIG. 7 is an enlarged perspective view of the electrode unit of the present invention in the second embodiment.
Figure 8:
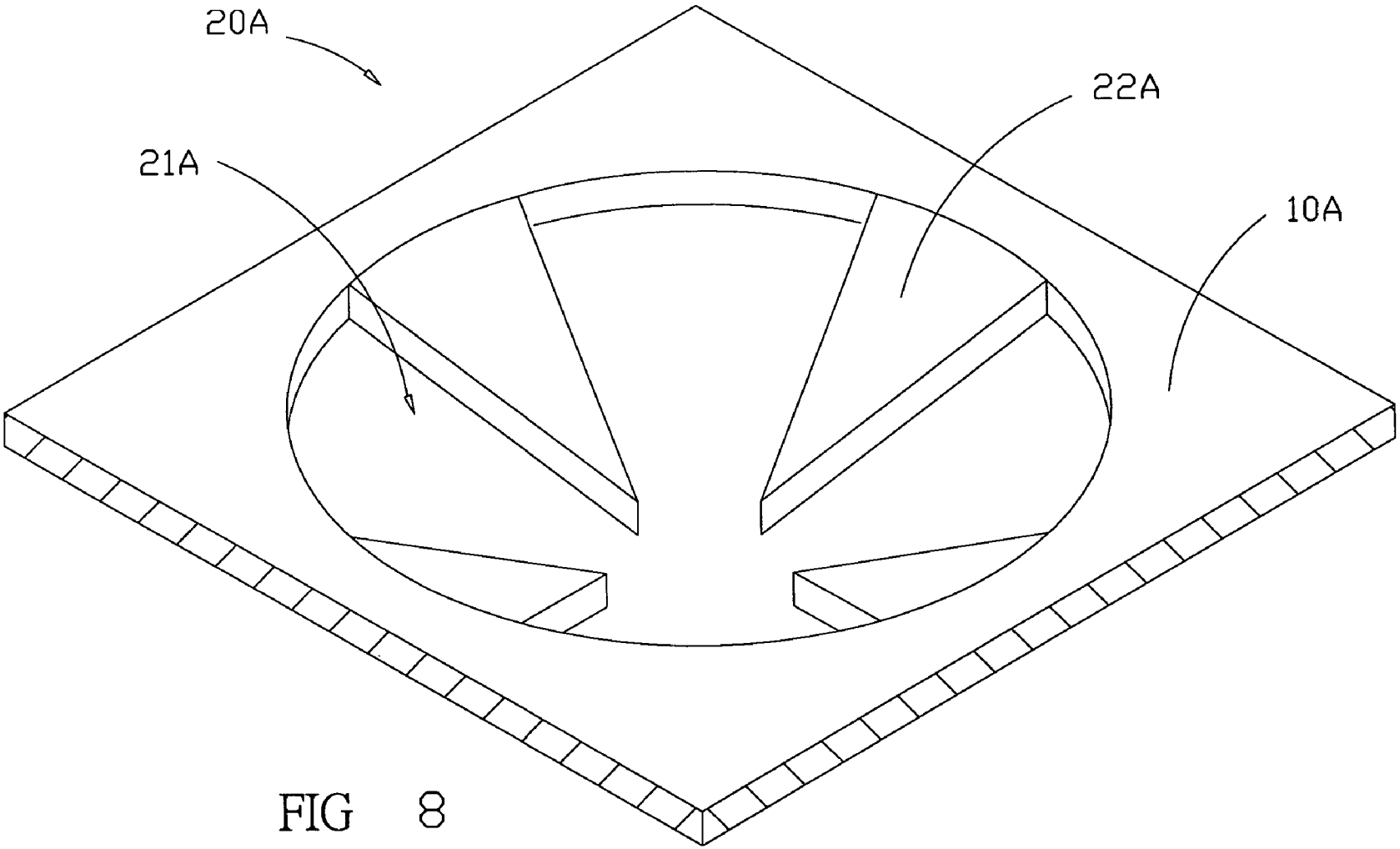
FIG. 8 is an enlarged cross-sectional view of the electrode plate and the collecting plate of the present invention in the second embodiment.

Referring to FIGS. 7-8, the present invention in a second embodiment has electrode units 20A with electrodes tips 22A that are bent towards the collecting plate 30 at defined angles, having tips that are closer to the collecting plate 30 than the distance between the electrode plate 10 to the collecting plate 30.

Figure 9:
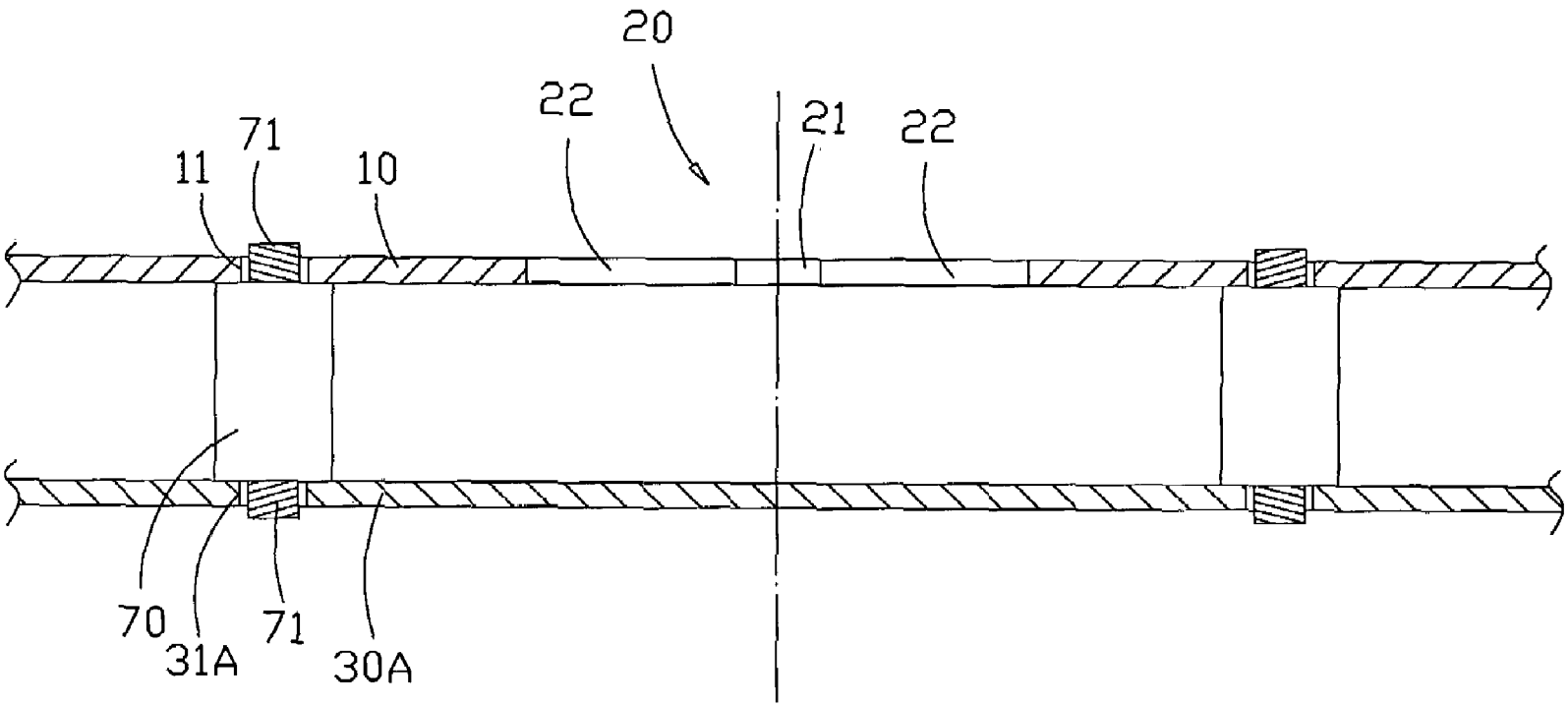
FIG. 9 is an enlarged cross-sectional view of the electrode plate and the collecting plate of the present invention in the third embodiment.

Referring to FIG. 9, the present invention in a third embodiment has a collecting plate 30A which is a single plane sheet without a collecting unit, with electric discharge occuring between the electrodes 22 of the electrode units 20 and the collecting plate 30A.

Figure 10:
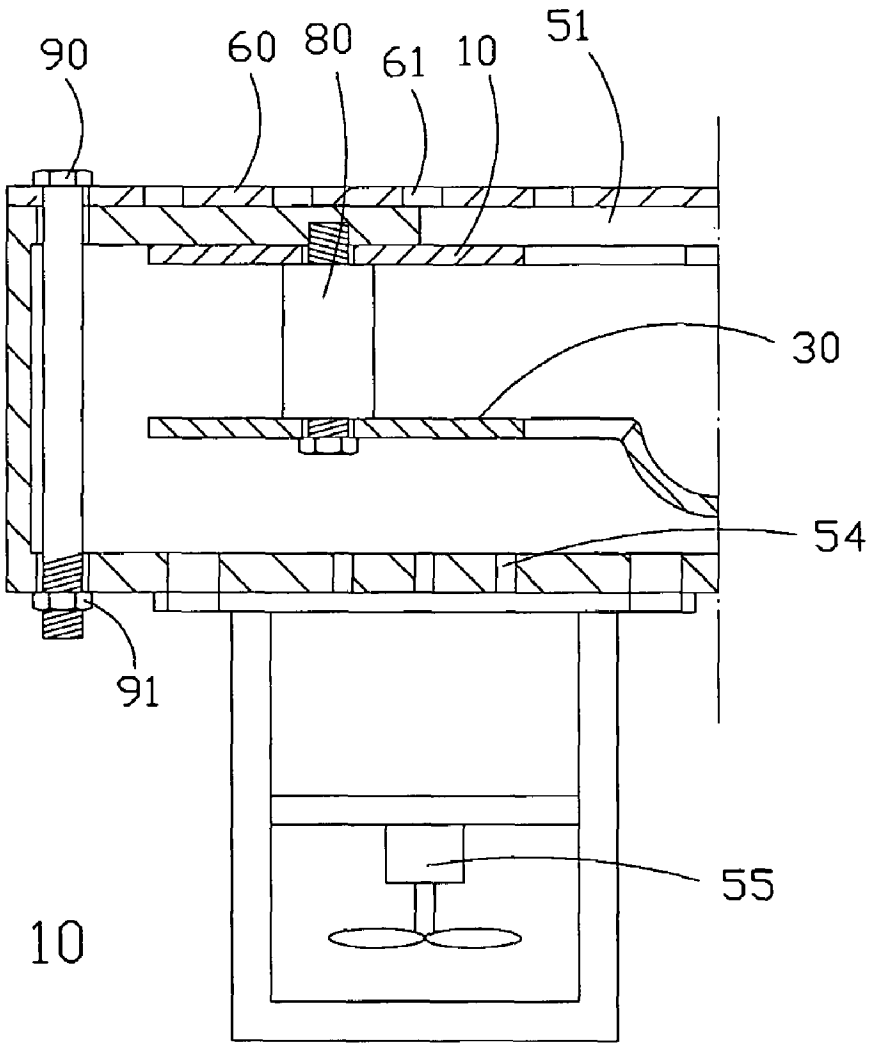
FIG. 10 is a partial cross-sectional view of the present invention in the fourth embodiment.

Referring to FIG. 10, the present invention in a fourth embodiment has several ventilation holes 54 on a rear side of the frame 50, with a ventilator 55 increasing air flow and hence air cleaning effectivity.

While the invention has been described with reference to preferred embodiments thereof, it is to be understood that modifications or variations maybe easily made without departing from the spirit of this invention which is defined by the appended claims.

The invention claim is:

1. A planar electric precipitator for an air stream, comprising:

planar electrode plate made of electricity-conducting material, having a plurality of electrode units arrayed thereon, each of said electrode units having at least one electrode opening with an inner periphery having at least two electrode tips;

a planar collecting plate, generally parallel to and downstream of said electrode plate and made of electricity-conducting material, having a plurality of collecting units arrayed thereon, each of said collector units having at least one air hole and at least one collector surface which is oriented transverse to a bulk air stream direction and positioned downstream of said corresponding electrode unit;

wherein direct electric voltage is applied between said electrode plate and said collecting plate, so that air passing through is exposed to high electric fields close to said electrode tips of said electrode units, ionizing suspended particles and trapping ionized particles at said collecting plate, so that an air-cleaning effect results.

2. The planar electric precipitator according to claim 1, wherein each of said collecting units has a plurality of air holes at rotationally equiangular positions adjacent to each of said collector surfaces.

3. The planar electric precipitator according to claim 1, wherein said electrode plate and said collecting plate are each a continuous sheet, with a plurality of fixing elements inserted between said electrode plate and said collecting plate, ensuring that said electrode plate and said collecting plate are oriented parallel to each other.

4. The planar electric precipitator according to claim 1, wherein each electrode unit of said plurality of electrode units comprises an electrode opening and a plurality of electrode tips.

5. The planar electric precipitator according to claim 4, wherein for each electrode unit of said plurality of electrode units, said plurality of electrode tips are bent away from said electrode opening at a defined angle.

6. The planar electric precipitator according to claim 4, wherein for each electrode unit of said plurality of electrode units, said plurality of electrode tips are oriented parallel to said electrode opening.

7. The planar electric precipitator according to claim 2, wherein said plurality of electrode units and said plurality of collecting units are centrally aligned to each other.

8. The planar electric precipitator according to claim 2, wherein each collecting unit of said plurality of collecting units comprises a collector surface, which is aligned directly downstream of said electrode opening of one electrode unit of said plurality of electrode units, wherein said collector surface causes stagnation flow downstream of said electrode opening.

9. The planar electric precipitator according to claim 8, wherein for each collecting unit of said plurality of collecting units, said collector surface is surrounded by several air holes, allowing air to pass through.

10. The planar electric precipitator according to claim 3, wherein said electrode plate and said collecting plate, with said fixing elements having been inserted, are mounted on a frame.

11. The planar electric precipitator according to claim 10, wherein said frame has a central opening, allowing air to pass through.

12. The planar electric precipitator according to claim 10, wherein said frame is covered by a cover plate to prevent accidental touching of said electrode plate.

13. The planar electric precipitator according to claim 12, wherein said cover plate has a plurality of ventilation openings, allowing air to enter said electrode plate.

14. The planar electric precipitator according to claim 13, wherein said cover plate has a decorative design for good looks.

15. The planar electric precipitator according to claim 4, wherein for each electrode unit of said plurality of electrode units, said plurality of electrode tips are bent towards said collecting plate at a defined angle.

16. The planar electric precipitator according to claim 10, wherein said frame on a side close to said collecting plate has at least one ventilator to increase air flow towards said electrode plate and said collecting plate.

17. The planar electric precipitator according to claim 16, wherein for each electrode unit of said plurality of electrode units, said plurality of electrode tips are oriented not parallel to said electrode plate, reaching closer to said collecting plate than said electrode plate does.

18. The planar electric precipitator according to claim 1, wherein said collecting plate is a single plane sheet.

19. The planar electric precipitator according to claim 10, wherein said electrode plate, said collecting plate and said frame are fastened to each other by bolts and nuts.

20. The planar electric precipitator according to claim 12, wherein said cover plate is fastened to said frame by screws and nuts.

* * * * *